181-198 SR
OR 4,308,426

United States Patent [19]
Kikuchi

[11] 4,308,426
[45] Dec. 29, 1981

[54] SIMULATED EAR FOR RECEIVING A MICROPHONE

[75] Inventor: Mitsuru Kikuchi, Yokohama, Japan

[73] Assignee: Victor Company of Japan, Limited, Yokohama, Japan

[21] Appl. No.: 49,556

[22] Filed: Jun. 18, 1979

[30] Foreign Application Priority Data

Jun. 21, 1978 [JP] Japan ..... 53-84051[U]

[51] Int. Cl.[3] ..... H04R 1/34

[52] U.S. Cl. ..... 179/1 MF; 179/1 G; 179/182 R

[58] Field of Search ..... 179/1 G, 1 MF, 1 DM, 179/107 E, 107 R, 182 R, 187

[56] References Cited

U.S. PATENT DOCUMENTS

| | | | |
|---|---|---|---|
| 1,485,918 | 3/1924 | Hearn | 179/187 |
| 2,643,729 | 6/1953 | McCracken | 179/187 |
| 4,037,052 | 7/1977 | Doi | 179/1 MF |
| 4,068,091 | 1/1978 | Doi | 179/1 G |
| 4,088,849 | 5/1978 | Usami et al. | 179/1 G |
| 4,119,798 | 10/1978 | Iwahara | 179/1 G |
| 4,143,244 | 3/1979 | Iwahara et al. | 179/1 G |

FOREIGN PATENT DOCUMENTS

| | | | |
|---|---|---|---|
| 2437373 | 2/1976 | Fed. Rep. of Germany | 179/1 G |
| 2542990 | 3/1977 | Fed. Rep. of Germany | 179/1 G |

*Primary Examiner*—Gerald L. Brigance
*Attorney, Agent, or Firm*—Lowe, King, Price & Becker

[57] ABSTRACT

A dummy head for use in recording binaural sounds includes a pick-up for the sounds in the form of two microphones. The head comprises a pair of simulated ears, each having a single smooth three-dimensional, curved surface extending radially in all directions so the inner surface of an auditory canal is continuous with the curved surface and the junction area between them is smoothly curved, to improve the frequency characteristics of the output signals of the microphones. The microphone is located in each ear.

17 Claims, 6 Drawing Figures

SIMULATED EAR FOR RECEIVING A MICROPHONE

FIELD OF THE INVENTION

This invention generally relates to simulated ears which are usually mounted on or integrally formed with a dummy head for recording binaural sounds. More particularly, the present invention relates to a simulated ear having a single smooth three-dimensional curved surface that provides an improvement in frequency characteristic obtained by such simulatedears.

BACKGROUND OF THE INVENTION

As well known, some binaural sound reproducing systems comprise two microphones respectively mounted on right and left simulated ears of a dummy head. It has been generally believed that the sizes and shapes of a dummy head as well as simulated ears have to be designed as close as those of actual human head and ears so as to record aural signals by microphones disposed in the simulated ears under almost the same conditions as a live person listens to the aural signals. However, the output signal of the microphone of a binaural recording system using simulated ears having almost the same shape as those of human being, i.e. the simulated ears have undulations on the front surfaces thereof, has a dip in its amplitude frequency characteristic curve in a range of approximately 8 KHz to 14 kHz. Because of this dip the response of the microphone at high frequencies is deteriorated so that hi-fi recording is disturbed, while the clarity of acoustic image is reduced. For this reason, the quality sounds reproduced by the conventional binaural sound reproducing system is apparently lower than that obtained by a regular stereophonic sound reproduction system. Although it seems to be possible to compensate for this dip by means of a suitable equalizer, it is quite impossible to employ such an equalizer since adoption of an equalizer introduces undesirably deteriorated signal-to-noise ratio.

SUMMARY OF THE INVENTION

The present invention has been developed in order to remove the above mentioned drawbacks inherent to the conventional dummy head or simulated ears used for binaural sound recording.

It is, therefore, a primary object of the present invention to provide a simulated ear for receiving a microphone by which aural signals are recorded or picked up without an undesirable dip in the frequency characteristic curve.

Another object of the present invention is to provide a simulated ear for receiving a microphone that enables binaural sounds to be recorded or picked up with high quality.

A further object of the present invention is to provide a simulated ear for receiving a microphone in which the high frequency response is improved.

A still further object of the present invention is to provide a simulated ear for receiving a microphone that enables binaural sounds to be recorded or picked up in such a manner that a binaural sound effect is maintained at the same level as in case of using conventional simulated ears.

According to the present invention, there is provided a simulated ear for receiving a microphone comprising: (a) an auditory canal containing the microphone; and (b) a single smooth three-dimentional curved surface extending radially in all directions from the mouth of said auditory canal to the perimeter of the ear.

The single smooth three-dimensional curved surface is to be contrasted with the prior art ears which have several undulations that simulate the shape of an actual human ear. It has been found that the smooth surface eliminates the high frequency dip of the prior art simulated ears since such a surface concentrates sounds to the microphone without constituting an acoustic filter for the microphone.

The inner surface of the canal is continuous with the curved surface so the area between them is smoothly curved.

BRIEF DESCRIPTION OF THE DRAWINGS

These and other objects and features of the present invention will become more readily apparent from the following detailed description of the preferred embodiments taken in conjunction with the accompanying drawings in which.

DETAILED DESCRIPTION OF THE PREFERRED EMBODIMENTS

Prior to describing the preferred embodiments of the simulated ear according to the present invention, a conventional simulated ear will be discussed for a better understanding of the objects of the present invention.

Figure 1:
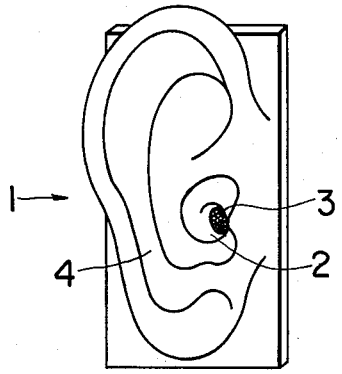
FIG. 1 PRIOR ART
FIG. 1 is a perspective view of a conventional simulated ear.
Figure 5:
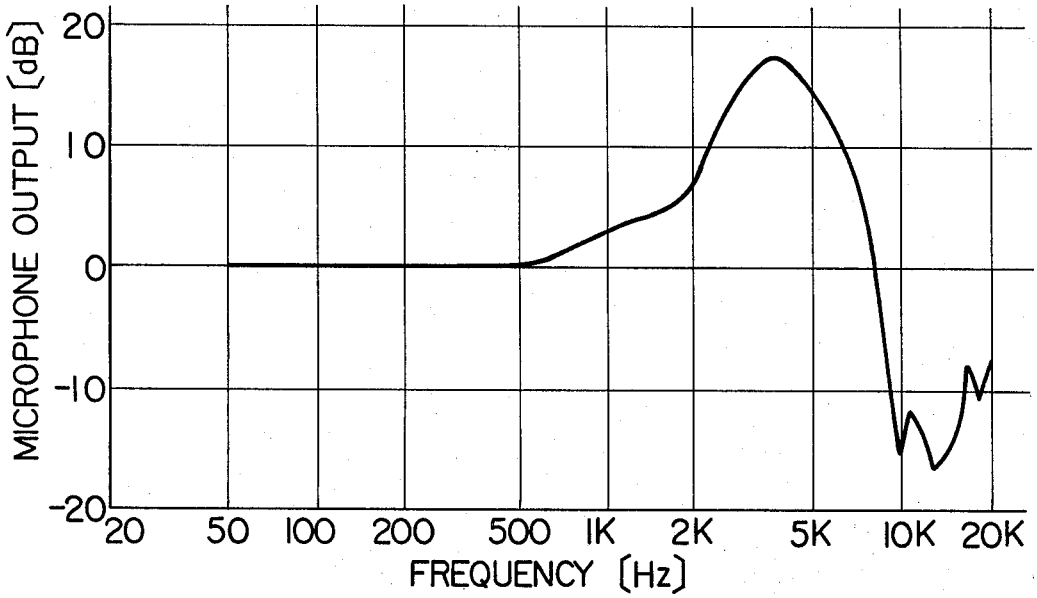
FIG. 5 PRIOR ART
FIG. 5 is a graph representing frequency response obtained by a microphone disposed in a conventional simulated ear shown in FIG. 1.

FIG. 1 is an illustration of a conventional simulated ear 1 used for recording binaural sounds. The conventional simulated ear 1 and comprises an auditory canal 2 in which a suitable microphone 3 is disposed so as to pick up sounds collected and concentrated by the simulated ear 1. Simulated ear 1 has a front surface with undulatory portions 4 since the conventional simulated ear 1 is made after the fashion of an actual ear of a human being. Therefore, the amplitude frequency response curve of the output signal of the microphone 3 has a dip in a range of approximately 8 kHz to 14 kHz as shown in FIG. 5.

Experiments were done to find the cause of this dip in the frequency response curve. As the result of the experiments, it has been found that the undulatory portions 4 and the microphone 3 constitute an acoustic filter that cause the dip. It has been found that, if the front surface of the simulated ear 1 is made flat or smooth by either (1) filling recesses on the front surface with a material having the same reflection coefficient as that of the material used for the simulated ear body, or (2) forming a simulated ear in such a manner that the front surface of the simulated ear is flat from the beginning, such an acoustic filter does not occur to prevent deterioration of the frequency response.

Figure 2:
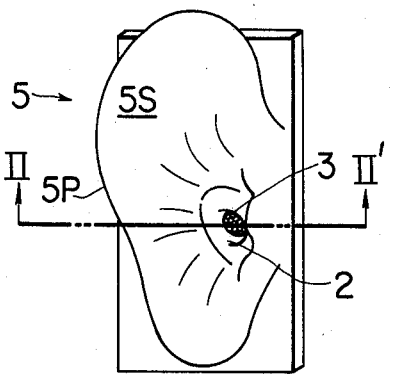
FIG. 2 is a perspective view of first and second embodiments of a simulated ear according to the present invention.

Hence, reference is now made to FIG. 2, a schematic perspective view of first and second embodiments of the simulated ear according to the present invention. Although the external views of the first and second embodiments have the same or like appearances as illustrated in FIG. 2, these first and second embodiments are respectively shown in detail by means of cross-sectional views of FIG. 3 and FIG. 4. The cross-sectional views of FIG. 3 and FIG. 4 are obtained by taking along the line II—II' of FIG. 2.

Figure 3:
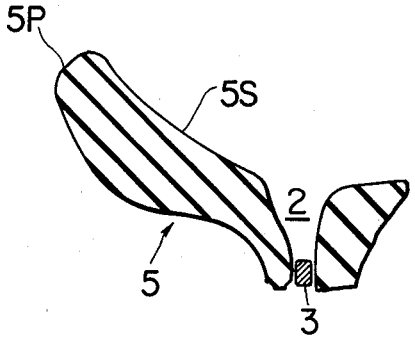
FIG. 3 is a cross-sectional view of the first embodiment of the simulated ear taken along the line II–II' of FIG. 2.

As shown in FIG. 2 and FIG. 3, the simulated (artificial) ear of the first embodiment comprises a body 5 including an auditory canal 2. All of body 5 except auditory canal 2 is called a pinna. A suitable microphone 3 is inserted in the auditory canal 2 in the same way as in the conventional simulated ear. The body 5 of the simulated ear is made of an elastomeric material, such as silicone rubber or synthetic resin, and is formed in a suitable die by injection molding. It is to be noted that the body 5 of the simulated ear has a single smooth three-dimensional curved surface 5 extending from the mouth of the auditory canal 2 to the perimeter 5P of the body 5. In other words, the pinna has a structure simulating the dimensions and a contour of the human pinna and having a hole therein for receiving the microphone 3 and a concaved, non-undulating surface extending from the open end of the hole to the perimeter of the pinna. As the result of this arrangement, undulatory portions which are inherent to conventional simulated ears have been omitted.

Figure 4:
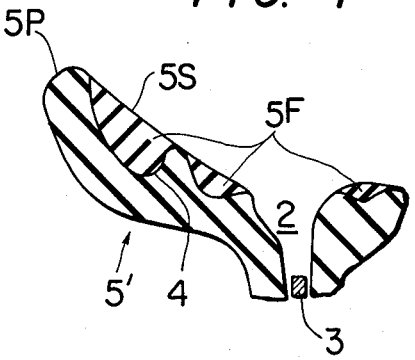
FIG. 4 is a cross-sectional view of the second embodiment of the simulated ear taken along the line II–II' of FIG. 2.

Reference is now made to FIG. 4 wherein a second embodiment of the invention is illustrated as including a conventional, prior art, simulated ear body 5', (as illustrated in FIG. 1). Recesses defined by the undulatory portions 4 of the conventional ear body 5' are filled with a suitable filling 5F, having a reflection coefficient substantially the same as that of the material of the body 5'. For instance, elastomeric material such as clay or vinyl polymers which are used for making impressions, may be used. Of course the same material as that used for the ear body 5' may be used for the material of filling 5F. Since the recesses of the conventional ear are filled with the above mentioned suitable material in such a manner that the front surface 5S of the body 5' of the simulated ear is flat and smooth, the completed second embodiment simulated ear has an appearance substantially the same as that of the first embodiment of the simulated ear. Furthermore, since the reflection coefficient of the filling material is substantially the same as that of the body 5' of the simulated ear, the frequency characteristic of the second simulated ear embodiment corresponds with that of the first simulated ear embodiment.

Although the invention has been described and illustrated in connection with a single simulated ear, it is to be understood that it is intended to generate binaural-sound signals. In such a case a pair of simulated ears is used for recording or picking up a pair of aural signals with two microphones respectively disposed in auditory canals of the two simulated ears. These two simulated ears, i.e. right and left ears, may be integrally formed on a dummy head or two simulated ears may be mounted on a dummy head which has right and left recesses for receiving these ears. Of course if desired two simulated ears may be used without any dummy head, while two ears are properly arranged with a given space between them.

Figure 6:
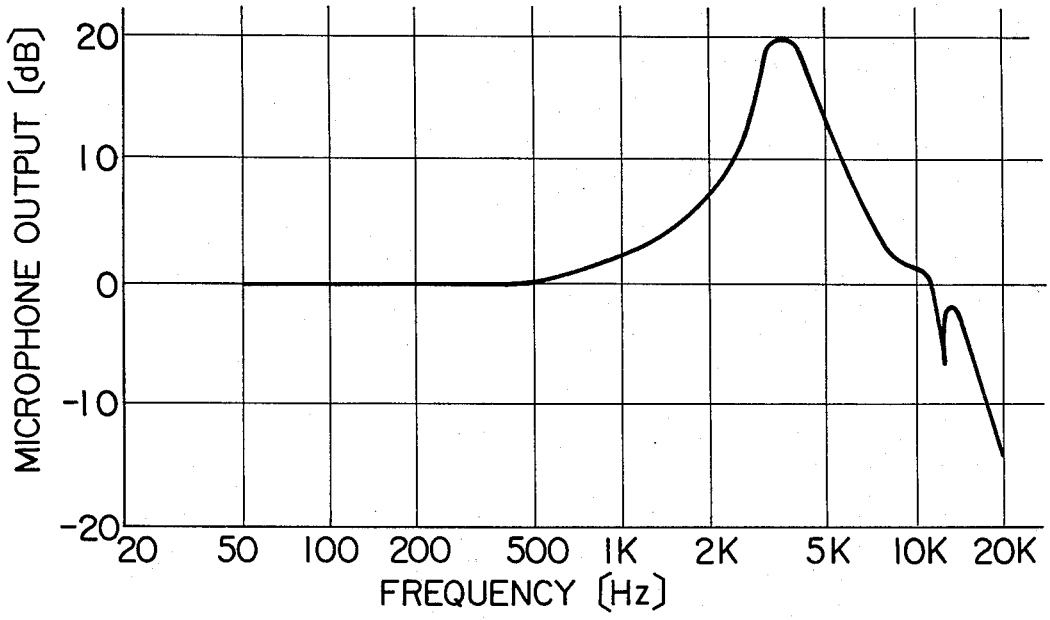
FIG. 6 is a graph representing a frequency response obtained by a microphone disposed in the simulated ear according to the present invention.

FIG. 6 is a graph representing the frequency characteristic of the output signal generated by the microphone 3 disposed in the auditory canal 2 of the simulated ear according to the present invention. This frequency characteristic curve was obtained by a simple experiment in which a speaker is located 30 degrees forward of the ear emits aural signals of various frequencies. Thus a speaker is effectively located at the same height as the ear and lies on a line intersecting a line passing through the mouths of the auditory canals of a pair of ears of a dummy head, at 60 degrees.

As described hereinbefore, the amplitude frequency characteristic curve shown in FIG. 5 results from an experiment done under the same condition with respect to the conventional simulated ear (FIG. 1). The frequency response of the structure of FIG. 2, as illustrated in FIG. 6, is considerably better than that obtained by using the conventional simulated ear as illustrated in FIG. 5. In particular the dip inherent in the amplitude frequency characteristic curve shown in FIG. 5 is eliminated from the curve of FIG. 6, improving the response at approximately 10 kHz by over 10 dB. This improvement contributes to the improvement in the sound quality and the acoustic image, and the degree of the improvement is more than expected.

As is well known, the binaural sound effect occurs because of the differences in time and sound pressure between right and left channel signals respectively picked up by a pair of microphones disposed in auditory canals of simulated right and left ears. In other words, two frequency characteristics based on these differences are obtained; without these two frequency characteristics no binaural sound effect is achieved. According to experiments, the difference between these two frequency characteristics obtained by the pair of simulated ears according to the present invention is substantially equal to that in case of using a conventional pair of ears. Furthermore, the aural characteristic resulting from the simulated ears according to the present invention is substantially the same as that attained by the conventional simulated ear.

What is claimed is:

1. A simulated ear having a structure generally the same as the contour of a normal human ear for receiving a microphone comprising:
   (a) an auditory canal for receiving said microphone; and
   (b) A single smooth three-dimensional curved surface extending radially in all directions from the mouth of said auditory canal to the perimeter of said ear for concentrating sounds to said microphone without constituting an acoustic filter for said microphone, the inner surface of said auditory canal being continuous with said single smooth three-dimensional curved surface so that the junction area therebetween is smoothly curved.

2. A simulated ear as claimed in claim 1, wherein said simulated ear is formed by injection molding.

3. A simulated ear as claimed in claim 1, wherein said single smooth three-dimensional curved surface comprises recesses defined by undulatory portions on the front surface of said simulated ear, said undulatory portions being shaped similar to undulations of a normal human ear, and filling filled into said recesses.

4. A simulated ear as claimed in claim 1, wherein said simulated ear is made of an elastomeric material.

5. A simulated ear as claimed in claim 3, wherein said filling is made of an elastomeric material.

6. A simulated ear as claimed in claim 5, wherein the reflection coefficient of said elastomeric material is substantially equal to that of the material of said conventional simulated ear.

7. A dummy head for the use of picking up aural signals to generate binaural-sound signals, comprising;

a pair of simulated ears having a structure generally the same as the contour of a normal human ear, each of said simulated ears including an auditory canal for receiving a microphone therein, and a single smooth three-dimensional curved surface extending radially in all directions from the mouth of said auditory canal to the perimeter of said simulated ear for concentrating sounds to said microphone, the inner surface of said auditory canal being continuous with said single smooth three-dimensional curved surface so that the junction area therebetween is smoothly curved.

8. A dummy head as claimed in claim 7, wherein said simulated ears are integrally formed with the body of said dummy head.

9. A dummy head as claimed in claim 7, wherein said simulated ears are received in recesses provided on the surface of said dummy head.

10. The dummy head of claim 7 wherein the curved surface is curved in both longitudinal and transverse directions thereof.

11. An artificial pinna comprising a structure generally having the same contour as a human pinna and having a hole therein for receiving therein a microphone, and a single smooth three-dimensional concave, non-undulating surface extending radially in all directions from the open end of said hole to the perimeter thereof for concentrating sounds to said microphone without constituting an acoustic filter for said microphone, the inner surface of said hole being continuous with said single smooth three-dimensional concave, non-undulating surface so that the junction area therebetween is smoothly curved.

12. The artificial pinna of claim 11 wherein the curved surface is curved in both longitudinal and transverse directions thereof.

13. A simulated ear as claimed in claim 11, wherein the structure generally has dimensions the same as those of human pinna.

14. A simulated ear having a structure generally the same as the contour of a normal human ear for receiving a microphone comprising:

(a) an auditory canal for receiving said microphone; and (b) a single smooth three-dimensional curved surface extending radially in all directions from the mouth of said auditory canal to the perimeter of said ear for concentrating sounds to said microphone, the inner surface of said auditory canal being continuous with said single smooth three-dimensional curved surface so that the junction area therebetween is smoothly curved, whereby undulations on the interior of a normal human ear are not included and the simulated ear has an amplitude in the 8–12 kHz frequency range that is approximately the same as in the 100–500 Hz frequency range.

15. In a simulated human ear, a simulated pinna having an exterior contour generally the same as the exterior contour of a human pinna and an interior contour that differs from that of a normal human pinna by having the undulating surfaces of a normal human pinna replaced by a single smooth three-dimensional curved surface that extends radially in all directions from an interior canal remote from the exterior contour to the exterior contour, the canal being positioned and shaped to be substantially the same as a normal human auditory canal acoustically coupled to the normal human pinna, the inner surface of the canal being continuous with said single smooth three-dimensional curved surface so that the junction area therebetween is smoothly curved.

16. A simulated ear as claimed in claim 15, wherein the simulated pinna and the interior canal are dimensioned so they are respectively substantially the same as that of a normal human pinna and a normal human canal.

17. The simulated ear of claim 1, 14 or 15 wherein the curved surface is curved in both longitudinal and transverse directions thereof.

* * * * *